340-566 SR
5/26/81 OR 4,270,122

United States Patent [19]

Capula

[11] 4,270,122

[45] May 26, 1981

[54] PRESSURE-SENSITIVE SIGNALLING DEVICE FOR DETECTING INTRUSION INTO AN ENCLOSED AREA

[76] Inventor: Pietro Capula, Via Arduino 91, Ivrea, Torino, Italy

[21] Appl. No.: 62,474

[22] Filed: Jul. 31, 1979

[30] Foreign Application Priority Data

Aug. 24, 1978 [IT] Italy ..... 68965 A/78

[51] Int. Cl.[3] ..... G08B 13/10
[52] U.S. Cl. ..... 340/566; 310/311
[58] Field of Search ..... 340/566, 38 R; 235/92 TC; 310/311

[56] References Cited

U.S. PATENT DOCUMENTS

| | | | |
|---|---|---|---|
| 3,109,165 | 10/1963 | Bagno | 340/566 |
| 3,438,021 | 4/1969 | Nelkin et al. | 340/566 |
| 3,665,445 | 5/1972 | Riley, Jr. | 340/566 |
| 4,081,785 | 3/1978 | Ravis et al. | 340/566 |

*Primary Examiner*—Glen R. Swann, III
*Attorney, Agent, or Firm*—Holman & Stern

[57] ABSTRACT

A signalling apparatus with pressure sensors, in particular for sensing intrusion into a closed surface area, with a yielding pipe embedded underground along the periphery of the surface area and filled with fluid; the pipe being divided into two separate sections by a deformable baffle plate to which are connected sensor means for supplying a signal depending on the deformation of said baffle plate, for initiating signalling means when said baffle plate is deformed.

8 Claims, 3 Drawing Figures

PRESSURE-SENSITIVE SIGNALLING DEVICE FOR DETECTING INTRUSION INTO AN ENCLOSED AREA

BACKGROUND OF THE INVENTION

FIELD OF THE INVENTION

The present invention relates to elements of an apparatus which signals intrusion into an enclosed area.

Apparatuses of this type are known which consist substantially of a pair of yielding tubes filled with fluid, positioned side-by-side and embedded underground, extending for the entire perimeter of the surface to be covered, such pipes are also provided at one of their extremities with an equal number of receiver transducers; in this way, when the fluid contained in one of the two pipes receives an impulse from the outside, due for example to the passing of a person over the terrain, differentiated signals are sent to the transducers of a kind such as to activate an alarm.

This principle is of great value, inasmuch as it means that even very weak signals can be captured, such as for example those caused by persons crawling on the terrain. Additionally, in this manner there is actuated a wholly hidden signaller which it is impossible to deactivate except from the inside of the protected area.

Nevertheless, an apparatus of this type has a considerable defect; for, as will be appreciated, the alarm signal has to be activated by very small impulse variations inasmuch as the pressure brought to bear by a person on the terrain generates to the fluid of one of the two pipes a very slight impulse as compared with the rest condition.

The alarm, therefore, must function when the signals coming from the two transducers are hardly at all differentiated—a differentiation of the order of a few millivolts. The result of this is that environmental factors such as wind, rain or very busy roads and nearby railways can frequently cause small variations in the impulses to the fluids of the two pipes, of a kind that can activate the alarm at any time.

The dependability of this device thus falls down precisely because the two transducers in this case would be supplying signals of the order of a few volts, so that is would be very easy for the signal of one pipe to deviate from the signal of its adjacent pipe by the few millivolts necessary to activate the alarm, which, as has been seen, must commence to function when a minimum difference exists between the two signals.

This occurs inasmuch as the impulse from the fluid contained in the pipes to the alarm arrives through two sensors each connected to a membrane positioned at the end of each tube, in direct contact with the fluid.

The behaviour of the membranes is not always definite, and in any case not linear, thus making it impossible to perceive useful signal levels beyond a certain limit by appropriately countering any external disturbances due, as has been seen, to atmospheric and environmental factors.

SUMMARY OF THE INVENTION

The present invention proposes the elimination of the above-described disadvantages by embodying an apparatus in which the membrane is single and the ends of both the pipes are in contact therewith.

In this way the membrane will deform on one side or the other only when one of the two tubes is more greatly affected by a deformation due to a pressure on the terrain.

On the other hand, when the impulse reaches the two pipes in identical manner, the membrane will remain immobile, supplying a nil signal to the two sensors. In this way there is embodied a mechanical system and not an electronic system as is the case with the known apparatuses. From this it follows that it is not necessary to employ two identical membranes—it is moreover practically impossible for them to be identical, especially when the signals are of great intensity—but only two identical tubes, so that their differentiated deformations will be as precise as possible.

For this and additional purposes, which will be more clearly set out hereinafter, the present invention proposes the embodiment of an element of a signaller apparatus featuring pressure sensors, in particular for sensing intrusion into an enclosed area, characterized by the fact that it comprises a yielding tube placed underground along the periphery of the area and filled with fluid, said tube being divided into two separate sections by a deformable baffle to which are connected sensor means for supplying a signal depending on the deformation of the baffle plate, for actuating a signalling means when the baffle is deformed.

BRIEF DESCRIPTION OF THE DRAWINGS

A preferred embodiment is now described as exemplifying the present invention though in no way limiting. This preferred embodiment of the invention according to the present application is referred to the attached drawings, in which.

DESCRIPTION OF THE PREFERRED EMBODIMENTS

Figure 1:
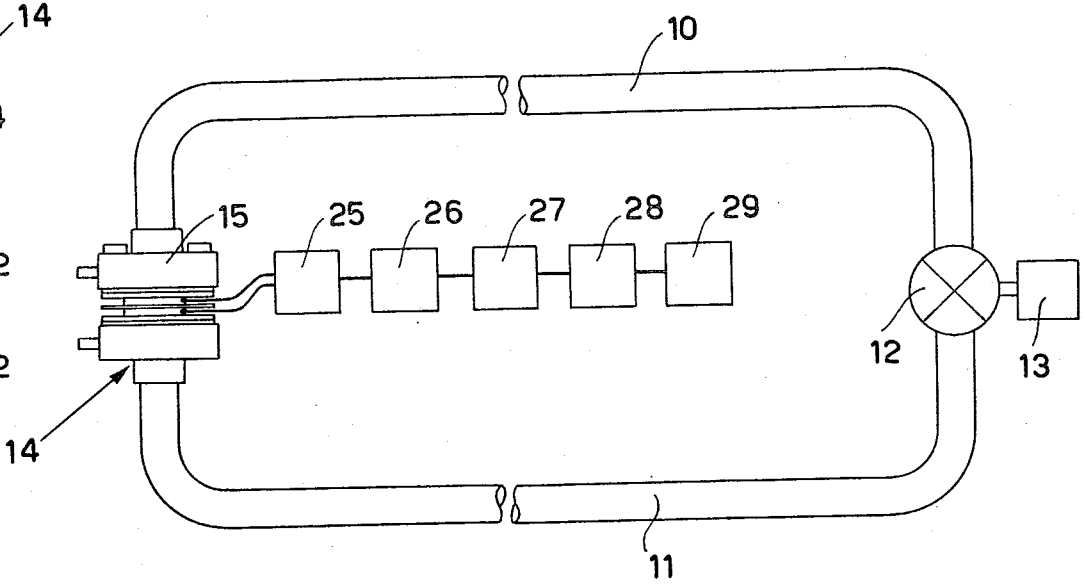
FIG. 1 is a general schematic view of an apparatus according to the invention.

A tube divided into two sections 10 and 11, which are parallel, of equal length and interspaced, is embedded underground at differing positions depending on the type of signal that they are intended to sense when an intruder walks on the terrain in their vicinity. For convenience of description, hereinafter mention will be made of two pipes 10 and 11 and not pipe sections.

The tubes 10 and 11 are advantageously of yielding material, and filled with liquid, with appropriate additives for lowering the freezing point when used in cold locations or in locations where the temperature varies greatly during the year. The tubes have a perfect seal and the liquid contained therein is pressurized at a pressure such as will determine a load of the tube as to attenuate to the greatest extent possible the signal losses due to the elastic properties of the said tube and to keep in constant equilibrium the degree of tension of the yielding material of the two tubes. Otherwise, that is to say, if the liquid were maintained at atmospheric pressure, the tubes would have a different degree of deformation one with respect to the other, which would adversely effect the precision of the signal which, as the tubes would deform in different degree, would be lost along them before reaching the sensor.

One end of each pipe 10, 11 is connected to that of the adjacent pipe by means of a valve 12, which is a filler valve which also provides a capillary communication between the fluid contained in the two pipes 10 and 11, so as to allow a slow balancing out of the pressures in the two pipes. This is requisite when, for example, vehicle is parked for a long time on the terrain around one of the two pipes, adversely affecting the balancing of the pressures between the said pipes.

A third inlet of the valve 12 serves to fill the liquid into the pipes 10 and 11 or for the pressurization of said liquid through an external unit 13.

Figure 2:
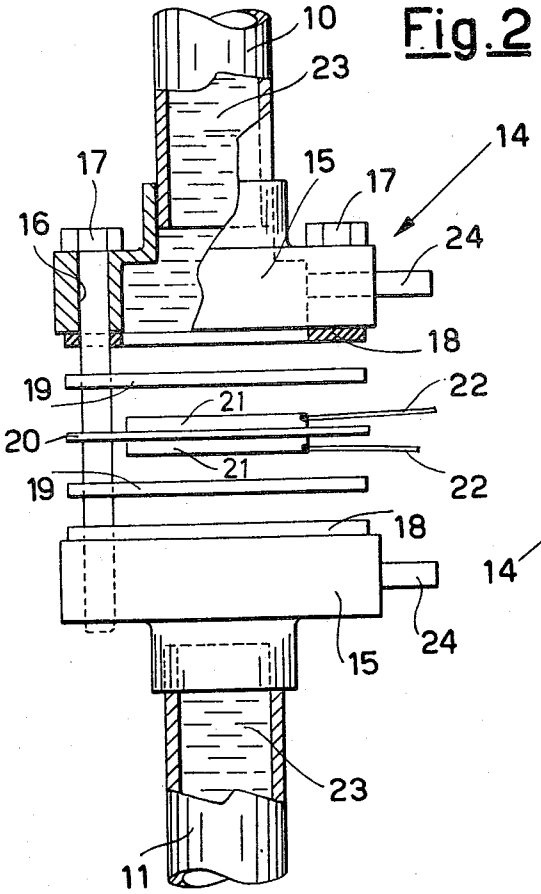
FIG. 2 is a blown-up view of a particular of the apparatus of FIG. 1.

The extremities of the two pipes 10 and 11 opposite the valve 12 carry the sensor unit 14 forming the subject matter of the invention, better illustrated in FIG. 2. This unit 14 consists substantially of a fittings 15, connected to each end of the two tubes, axially hollow and provided laterally with through holes 16 for joining each to the other by means of bolts 17.

Between the two fittings 15 annular seal gasketings 18 are interposed, and also insulating membranes 19 and a central membrane 20 supporting the sensors 21 provided with related connecting cables 22 to the unit for reception of the signal captured by the sensors and for its conversion into an alarm signal.

The speciific purpose of the insulating membranes 19 is to separate the liquid 23 of the pipes from the sensors 21, but without in the slightest degree altering the correct functioning of the apparatus.

Two vent plugs 24 close holes in the fittings 15 and are used to remove any air bubbles from the pipes possibly forming during installation, filling or functioning of the apparatus, which would considerably reduce the sensitivity of the system.

The sensors 21 are advantageously of the piezoelectric type, and the signals received by them are transmitted to a pre-amplifier-adder 25, then to an amplifier 26 and to a filter 27, followed by a threshold detector 28 for generation of an alarm signal 29 of whatsoever type.

The functioning of the apparatus described is as follows. The passage of a person over the terrain in which the pipes 10 and 11 are embedded causes an impulse to reach the fluid 23 contained in one pipe (the closest to the intruding person) thus causing a load on the membrane 20. This membrane is subject to two types of load, one of flexure and one of decompression. The latter load, as may be surmised, has a maximum value that is considerably inferior to the maximum flexure load to which the membrane can be subjected. The sensors 21 on each side of the membrane 20 are in practice two transducers for the conversion of mechanical loads on the membrane to tension signals and are secured to the membrane in the same direction, so that an identical load affecting the two pipes at the same time will produce an electric signal of equal sign. (For other types of sensor not sensitive to compression, a single sensor attached to one side only of the membrane may suffice).

Thus, when a person walks over the terrain in the vicinity of the pipes, they are affected one at a time, causing a flexure of the membrane 20 first on one side and then on the other.

In this way, the two sensors supply two voltage signals of opposite sign, even if not of identical value. The pre-amplifier-adder 25 which is arranged so as to adjust the sum of the two signals produced by the two sensors to attain a voltage value which, subsequently amplified at 26, filtered at 27 and compared with a pre-established basal value at 28, will certainly suffice to actuate the alarm 29, whatever this may be-luminous, acoustic, or other.

If, on the other hand, the external disturbance is caused by atmospheric agents (wind, rain) or environmental agents (road or rail traffic), the two pipes will deform simultaneously so that the membranes 20 will not deform, i.e. flex, either on one side or the other.

Thus the sensors 21 will be affected only by component of compression due to the fluid in turbulence in the pipes. The tension produced by the compression on the sensors 21 will however be very low as compared with that produced, as seen, by the flexure and will moreover have the same sign, and thus the pre-amplifier-adder 25 will sum the difference, forming at output a practically nil signal or a signal so small as not to overcome the indicator 28 and actuate the alarm 29.

Figure 3:
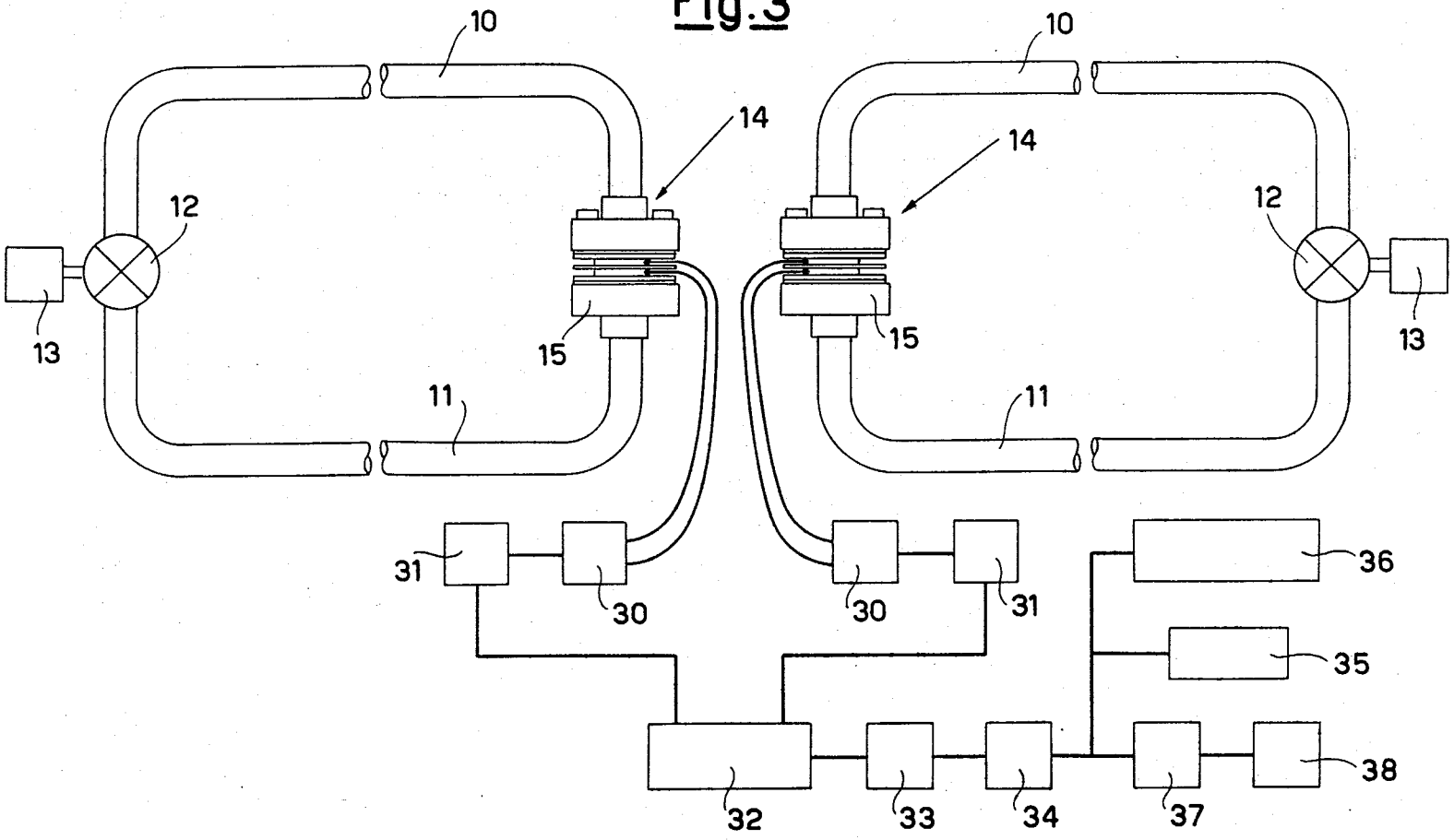
FIG. 3 is a general schematic view of a second form of embodiment of the apparatus according to the invention.

FIG. 3 illustrates the apparatus according to the invention in a further embodiment particularly suitable for installations in locations markedly disturbed by the external environment, such as airports or mechanical industries and the like.

According to this embodiment, the installation consists of a plurality of pairs of apparatuses of the type illustrated in FIG. 1, arranged in series, in which each pair covers a length of 200–300 meters, while the pairs follow one another to cover the entire perimeter to be protected.

FIG. 3 illustrates one of such pairs of apparatuses, all the pairs being identical.

The impulses received by each sensor 21 are, as has been seen, sent to and treated by two pre-amplifiers 30 and filtered at 31 so as to derive two signals of different voltage.

The difference between said signals is now detected in a single adder 32, and the resultant value is amplified at 33 and appropriately integrated at 34 with adjustable times.

The signal derived therefrom can, for example, be indicated by a zero center meter 35, so that there can be read both a plus signal or a minus signal, which fact makes it possible to calibrate the equilibrium of the system by adjusting the gains of pre-amplifiers 30 and amplifier 33.

A memorizer device 36, independent for the two channels, gives information as to any out-of-balance disturbance due to systematic noise or tremors occuring at such installations noted for unusual disturbances. Thus, the device can be monitored and if necessary, the balance between the tubes recalibrated.

The signal of the integrator 34 reaches a threshold indicator 37 with adjustable threshold, and thence to the alarm 38.

This signal will thus be a signal in logic "0", "1". able to pilot any alarm system 38.

By means of this embodiment, therefore, the sensitivity of the apparatus is increased, which is desirable when the place to be protected is so large as to require very long pipes—which would in any case entail signal dispersion. Furthermore, as has been seen, in the case of locations which are particularly noisy because of external environmental factors, with this application possible false alarms that might occur at any time during the life of the apparatus are eliminated.

The foregoing is a non-limiting exemple of a preferred form of embodiment of the invention according to the application, but it should be understood that formal and structural modifications can be made thereto without in any way detracting from the scope of the said invention, as protected also by the following claims.

I claim:

1. A pressure sensitive signalling device for sensing intrusion into an enclosed area, comprising at least one yeilding pipe embedded underground along the periphery of the enclosed area and filled with fluid, said pipe being divided into two separate sections by a deformable baffle plate to which are connected sensor means for supplying a signal depending on the deformation of said baffle plate, for actuating signalling means when said baffle plate is deformed.

2. A pressure-sensitive signalling device according to claim 1, wherein the at least one yielding pipe is double the length of the perimeter of the enclosed area and is embedded underground so as to constitute a double course in which the said two sections of pipe are constantly side-by-side and spaced along the entire periphery.

3. A pressure sensitive signalling device according to claim 1, wherein the deformable baffle plate consists of a central membrane on one or both opposite sides of which, facing the sections of pipe, are fitted pressure-sensitive transducer means consisting of piezoelectric crystals.

4. A pressure sensitive signalling device according to claim 1 or claim 3, wherein an insulating membrane is placed between the fluid of each section of pipe and the intermediate baffle plate.

5. A pressure sensitive signalling device according to claim 1, wherein the sensors are fitted on the baffle plate in such a way that the electric signals produced at the time of compression load on the baffle plate have the same sign.

6. A pressure sensitive signalling device according to claim 1, wherein the signals from the sensor means, said sensor means having at least two sensors, reach a pre-amplifier-adder which sums their difference and the resultant signal is amplified, filtered and sent to a threshold detector and from this to the signalling means.

7. A pressure sensitive signalling device according to claim 1, wherein said at least one yielding pipe comprises a plurality of pipes which in sequence cover the entire perimeter of the enclosed area and the signals of each pipe are added to those of the adjacent pipe to actuate the signalling means.

8. A pressure sensitive signalling device according to claim 1, characterized by the fact that the at least one yielding pipe is filled with liquid under pressure.

* * * * *